US006538186B1

(12) United States Patent
Huang

(10) Patent No.: US 6,538,186 B1
(45) Date of Patent: Mar. 25, 2003

(54) MUSIC BOX CONTAINER

(76) Inventor: Wen Chu Huang, 6F, No. 20, Lane 89, Sec. 2, Chung Shan Rd., Panchiao City (TW)

( * ) Notice: Subject to any disclaimer, the term of this patent is extended or adjusted under 35 U.S.C. 154(b) by 0 days.

(21) Appl. No.: 10/006,146

(22) Filed: Dec. 10, 2001

(51) Int. Cl.[7] ..... G10G 7/02
(52) U.S. Cl. ..... 84/453; 84/94.1
(58) Field of Search ..... 84/453, 94.1, 94.2, 84/95.1, 95.2, 96, 97, 98, 99

(56) References Cited

U.S. PATENT DOCUMENTS 5,571,979 A * 11/1996 Chen ..... 446/298
6,262,352 B1 * 7/2001 Liu ..... 446/309

* cited by examiner

*Primary Examiner*—Kim Lockett
(74) *Attorney, Agent, or Firm*—Rosenberg, Klein & Lee

(57) ABSTRACT

A music box container, comprising a box unit, a cover unit, a sound-emitting device, a transmission mechanism and a moving picture, wherein the transmission mechanism is installed in the box unit and the cover unit. The transmission mechanism includes a gear set and a connecting-rod mechanism. The gear set is joined between the sound-emitting device and the connecting-rod mechanism. The moving picture includes a frame unit and a plurality of moving objects. The frame unit is accommodated inside the cover unit. The moving objects are installed inside the frame unit and are connected with the connecting-rod mechanism. Thereby, the components include a music box container with a plurality of moving objects that swing leftward, rightward, upward, and downward.

6 Claims, 5 Drawing Sheets

MUSIC BOX CONTAINER

BACKGROUND OF THE INVENTION

1. Field of the Invention

The invention relates to a music box container, particularly to a music box container with a regular sound-emitting device to drive a plurality of moving objects to swing leftward, rightward, upward, and downward.

2. Description of the Prior Art

A conventional music box container used to contain jewelry and gems is made of a box unit and a cover unit, with a spring-activated sound-emitting device installed inside the box unit. The cover unit is opened from or closed to the box unit. When the cover unit is opened, the sound-emitting device inside the box unit starts to function and send out beautiful music.

The music box container may have moving objects in the shape of an animal, human or whatever configuration. When the cover unit is opened and the sound-emitting device starts to function, the moving objects also start to rotate, adding much fun and amusement.

The moving objects in a conventional music box container, however, can move only in a monotonous rotation. Furthermore, the conventional music box container has only one monotonous moving object, instead of a plurality of moving objects that move synchronously. In other words, it lacks amusement and fun.

It is obvious that the conventional music box containers do involve inconveniences and shortcomings in their applications that need improvement.

To seek possible improvement on the above shortcomings, the inventor has devoted in research and has finally come up with the present invention with a reasonable design and effectively improvement.

SUMMARY OF THE INVENTION

The primary objective of the invention is to provide a music box container involving a sound-emitting device that is capable of simultaneously activating a plurality of moving objects to swing leftward, rightward, upward, and downward, providing additional fun and amusement.

To achieve the above objective, the present invention provides a music box container comprising a box unit, a cover unit, a sound-emitting device, a transmission mechanism and a moving picture. The cover unit is joined to the box unit. Inside the cover unit is a formation of an accommodating space. The sound-emitting device is installed inside the box unit. The transmission mechanism comprises a gear set and a connecting-rod mechanism. The gear set is connected between the sound-emitting device and the connecting-rod mechanism. The moving picture comprises a frame unit and a plurality of moving objects. The frame unit is accommodated inside the accommodating space of the cover unit. The moving objects are installed inside the frame unit. The moving objects are joined to the connecting-rod mechanism. Thereby, the components are assembled to make the present invention of music box container.

For better understanding of the characteristics and technical approach of the present invention, please refer to the detailed description and drawings as follows. The accompanying drawings for the purpose of reference and description shall not be based to restrict the invention.

DETAILED DESCRIPTION OF PREFERRED EMBODIMENTS

Figure 1:
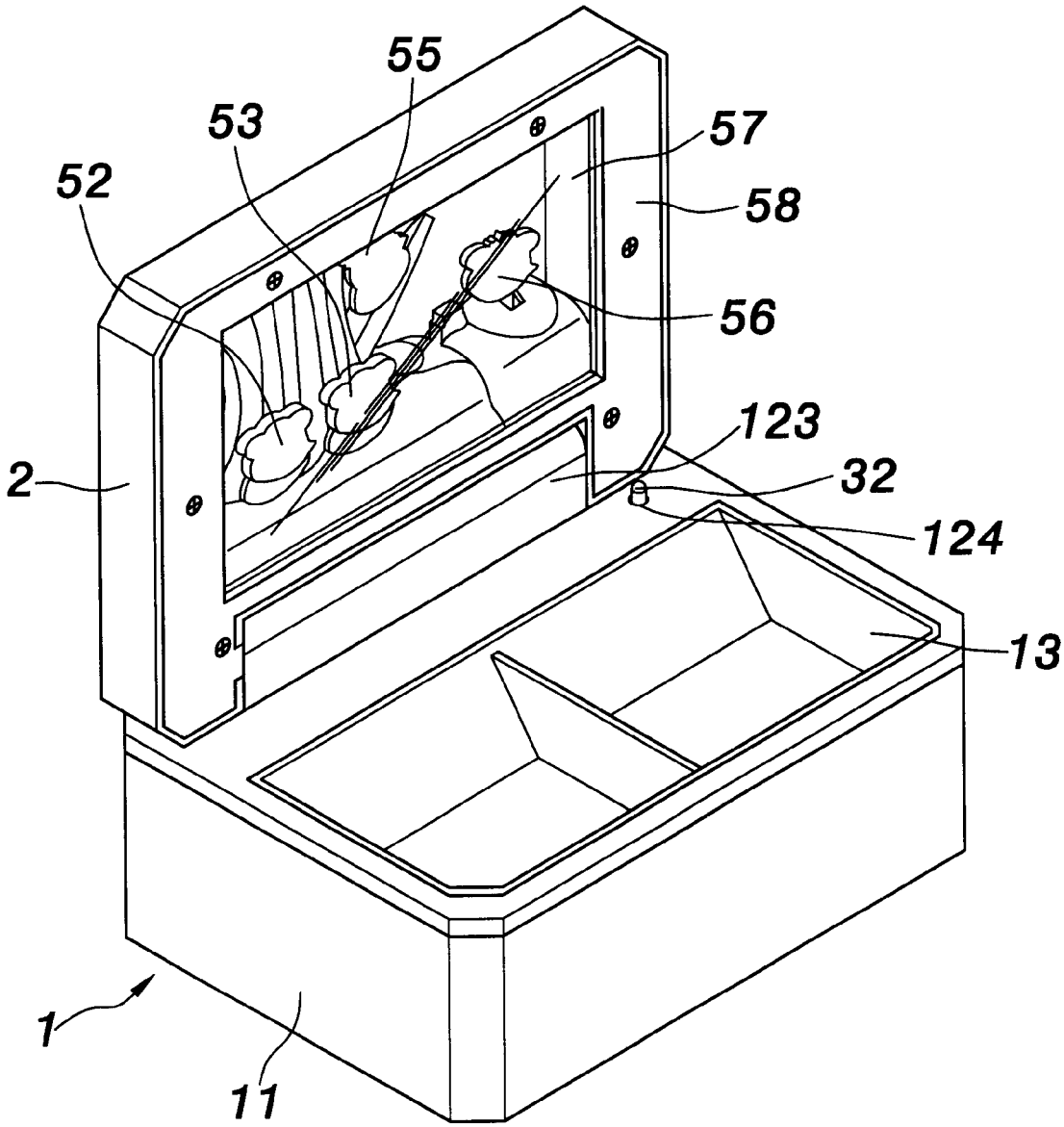
FIG. 1 is a perspective view of the invention.
Figure 2:
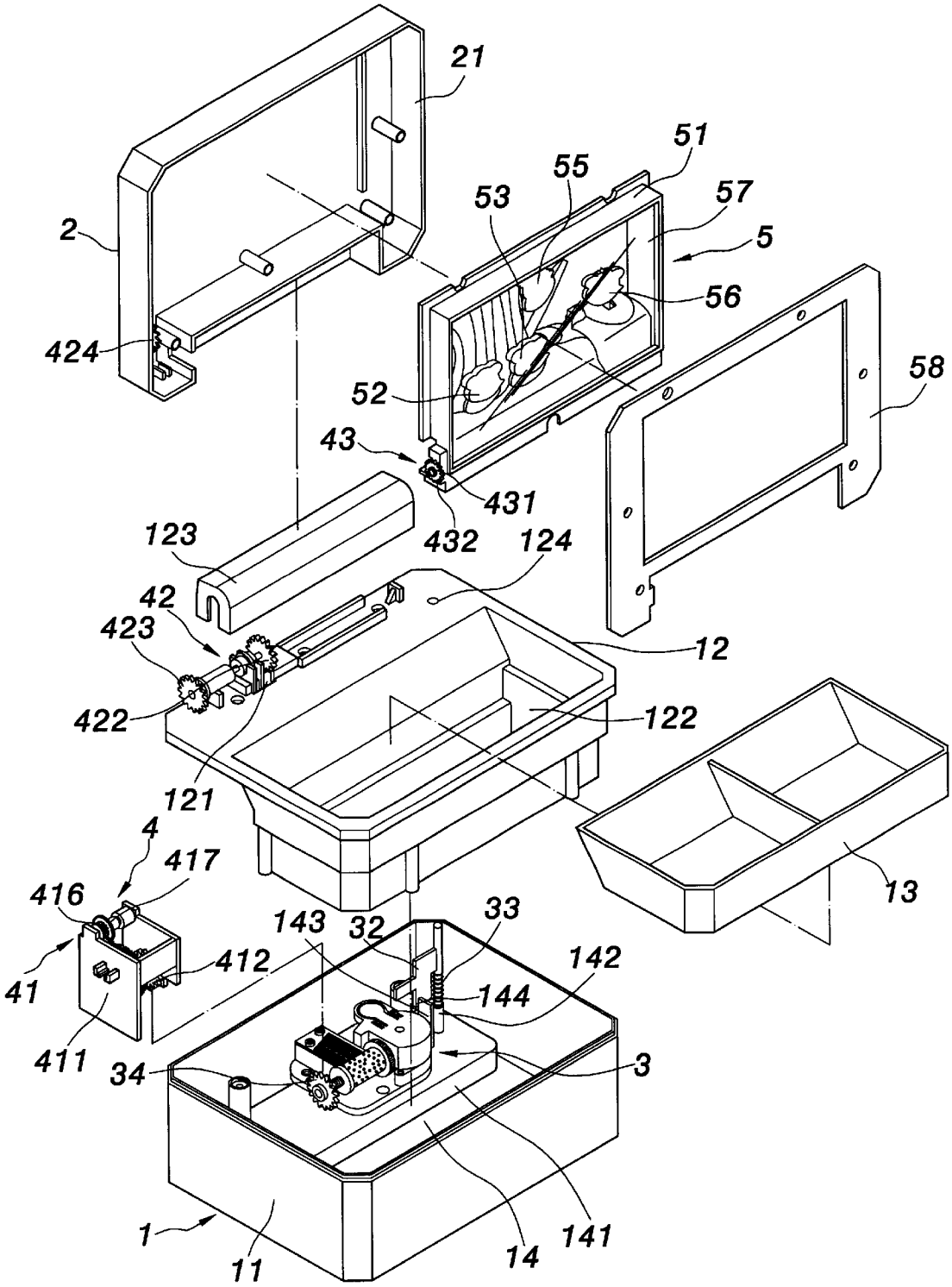
FIG. 2 is an exploded view of the invention.
Figure 3:
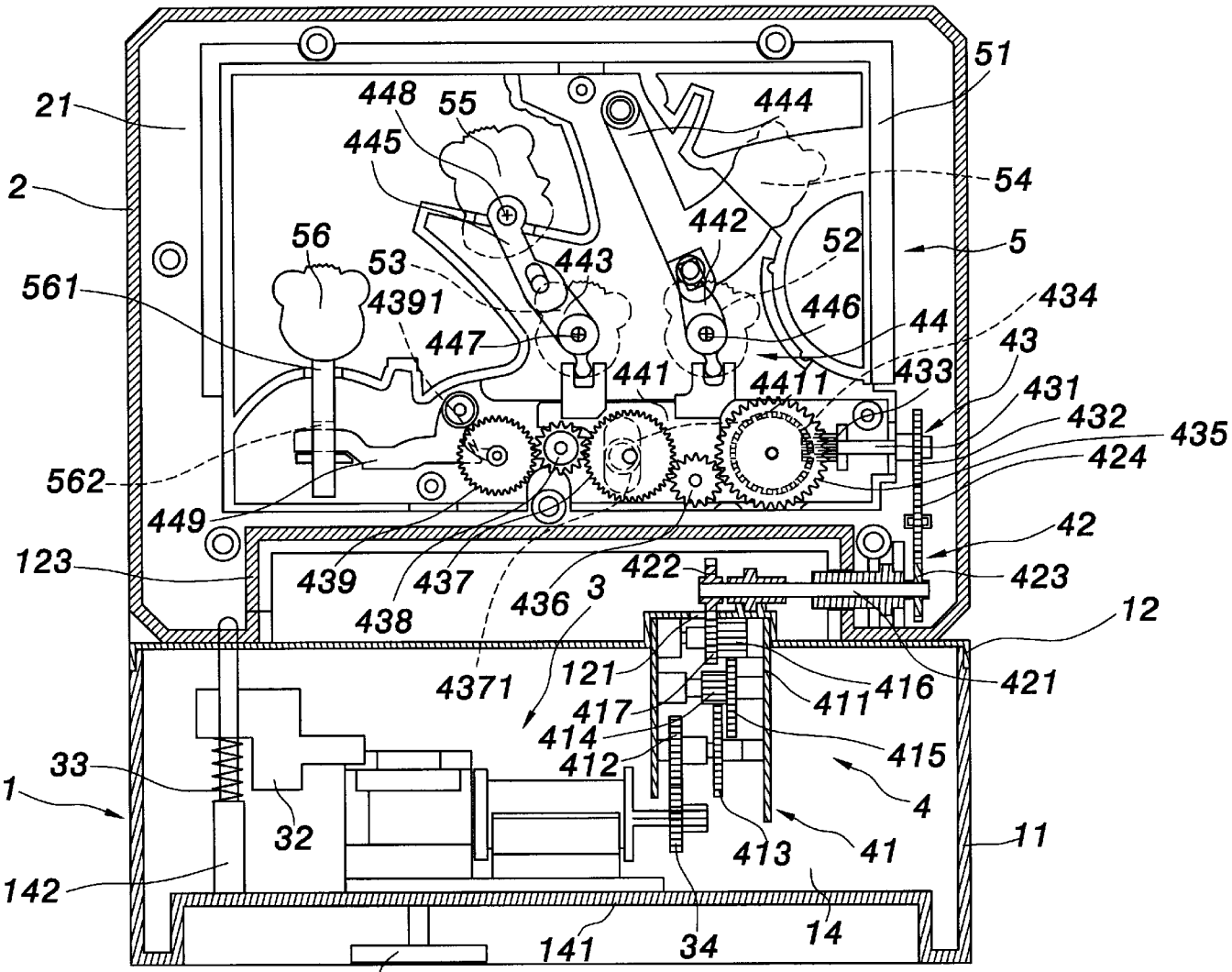
FIG. 3 is a section view of the invention.

As shown in FIGS. 1, 2 and 3, the invention relates to a music box container, comprising a box unit 1, a cover unit 2, a sound-emitting device 3, a transmission mechanism 4 and a moving picture 5, wherein the box unit 1 consists of a lower unit 11, an upper unit 12 and an inner box 13. The lower unit 11 has a hollow casing with a top opening and an inside formation of a first accommodating space 14. Inside the first accommodating space 14 is a protruded unit 141. On the protruded unit 141 is a hole unit 142 and a guide unit 143. On the guide unit 143 is a vertically installed guide groove 144.

The upper unit 12 is accommodated inside and fastened by screws to the first accommodating space 14 of the lower unit 11. At rear side of a top end of the upper unit 12 has a first through hole 121 and a second through hole 124. At a front half part of the top of the upper unit 12 has a depressed groove 122. The inner box 13 is detachably mounted corresponding to the depressed groove 122. At rear side of the top end of the upper unit 12 has a joining unit 123. The joining unit 123 is an elongated hollow casing that is fastened by screws to the top and near the rear side of the upper unit 12.

The cover unit 2 is pivoted to the joining unit 123 of the box unit 1 in a way that the cover unit 2 can be opened or closed in relation to the box unit 1. The cover unit 2 is a hollow casing with an opened front, having a second accommodating space 21 therein.

The sound-emitting device 3 is similar to a regular spring-driven device, using a turning knob 31 to reserve a force of the spring before giving off delightful music from the sound-emitting device 3 when the spring is activated. The sound-emitting device 3 is fastened on a protruded unit 141 inside the first accommodating space 14 of the box unit 1.

The sound-emitting device 3 has a music cut-off member 32 that is inserted on the hole unit 142 at one side of the sound-emitting device 3. The music cut-off member 32 slides corresponding to the guide groove 144 of the guide unit 143, the guide groove 144 guiding the music cut-off member 32 to move steadily up and down. On the music cut-off member 32 is disposed an elastic member 33 that serves to push the music cut-off member 32 to move upward, to the effect that the music cut-off member 32 escapes the sound-emitting device 3, and the sound-emitting device 3 gives off music smoothly.

An upper end of the music cut-off member 32 penetrates the second through hole 124 of the box unit 1, extending out of the top of the box unit 1. When the cover unit 2 is covered, the cover unit 2 pushes against the music cut-off member 32, compressing the elastic member 33 to move downward. Then, the music cut-off member 32 extends into the sound-emitting device 3, catching and obstructing the sound-emitting device 3 to operate; thereby the sound-emitting device 3 will not function when the cover unit 2 is in a covered status. Since the sound-emitting device 3 and the music cut-off member 32 relate to a conventional technology that is not included in the subject claim, they need no elaboration here. The present invention involves a drive output gear 34 that is linked to the sound-emitting device 3 for synchronous rotation.

The transmission mechanism 4 comprises a first gear set 41, a second gear set 42, a third gear set 43 and a connecting-rod mechanism 44. The first gear set 41 comprises a gear box 411, a first gear 412, a second gear 413, a third gear 414, a fourth gear 415, a fifth gear 416 and a sixth gear 417.

The gear box 411 is a hollow casing that is installed and fastened optionally by screws to an inside of the first accommodating space 14 of the box unit 1. The first gear 412, the second gear 413, the third gear 414, the fourth gear 415, the fifth gear 416 and the sixth gear 417 are installed inside the gear box 411.

The first gear 412 is engaged with the drive output gear 34 of the sound-emitting device 3 in a way that the drive output gear 34 is engaged with the first gear set 41. The first gear 412 and the second gear 413 are coaxially installed and joined together. The second gear 413 and the third gear 414 are engaged with each other. The third gear 414 and the fourth gear 415 are coaxially installed and joined together. The fourth gear 415 and the fifth gear 416 are engaged with each other. The fifth gear 416 and the sixth gear 417 are coaxially installed and joined together.

Rotating of the drive output gear 34 of the sound-emitting device 3 transmit an accelerated drive force in sequence from the first gear 412, the second gear 413, the third gear 414, the fourth gear 415 and the fifth gear 416 to the sixth gear 417, then further to the second gear set 42.

The second gear set 42 comprises a transmission shaft 421, a seventh gear 422, an eighth gear 423 and a ninth gear 424. The transmission shaft 421 is installed for free rotation at a top of the upper unit 12 of the box unit 1. The seventh gear 422 and the eighth gear 423 are fixed at two ends of the transmission shaft 421 in a way that the seventh gear 422 and the eighth gear 423 are coaxially installed and joined together. An upper part of the sixth gear 417 penetrates the first through hole 121 of the box unit 1 to the effect that the sixth gear 417 is exposed at the top of the box unit 1. The seventh gear 422 is engaged with the sixth gear 417 of the first gear set 41. The ninth gear 424 is installed inside the cover unit 2. The eighth gear 423 is engaged with the ninth gear 424.

Rotating of the drive output gear 34 of the sound-emitting device 3 transmits a driving force in sequence from the seventh gear 422 and the transmission shaft 421 of the first gear set 41 and the second gear set 42, and the eighth gear 423 to the ninth gear 424, and further to the third gear set 43.

The third gear set 43 comprises a transmission shaft 431, a tenth gear 432, an eleventh gear 433, a twelfth gear 434, a thirteenth gear 435, a fourteenth gear 436, a fifteenth gear 437, a sixteenth gear 438 and a seventeenth gear 439. The transmission shaft 431 is pivoted for free rotation at a rear side of a moving picture 5 inside the cover unit 2. The tenth gear 432 and the eleventh gear 433 are fixed to two ends of the transmission shaft 431 in a way that the tenth gear 432 and the eleventh gear 433 are coaxially installed and joined together. The tenth gear 432 is engaged with the ninth gear 424 of the second gear set 42.

Figure 4:
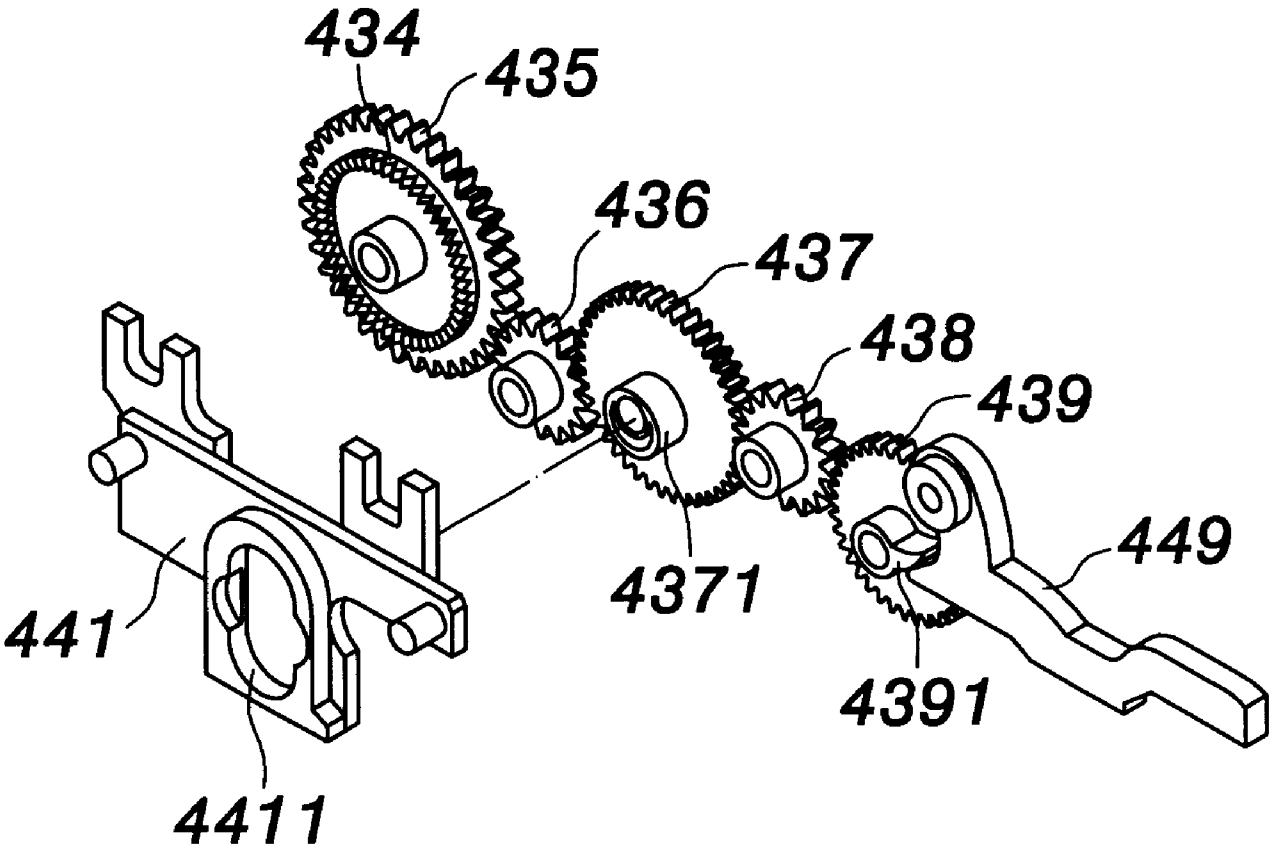
FIG. 4 is a perspective view of the transmission mechanism of the invention.

The twelfth gear 434, the thirteenth gear 435, the fourteenth gear 436, the fifteenth gear 437, the sixteenth gear 438 and the seventeenth gear 439 are installed at a rear side of the moving picture 5 inside the cover unit 2. The twelfth gear 434 and the thirteenth gear 435 are joined together (please refer simultaneously to FIG. 4). The eleventh gear 433 is engaged with the twelfth gear 434. The thirteenth gear 435 is engaged with the fourteenth gear 436. The fourteenth gear 436 is engaged with the fifteenth gear 437. The fifteenth gear 437 is engaged with the sixteenth gear 438. The sixteenth gear 438 is engaged with the seventeenth gear 439.

Rotating of the drive output gear 34 of the sound-emitting device 3 transmit a driving force in sequence from the first gear set 41, the tenth gear 432 and the transmission shaft 431 of the second gear set 42 and the third gear set 43, the eleventh gear 433, the twelfth gear 434, the thirteenth gear 435 and the fourteenth gear 436 to the fifteenth gear 437, the sixteenth gear 438 and the seventeenth gear 439.

The fifteenth gear 437 and the seventeenth gear 439 are respectively disposed to an eccentric gear 4371 and a switching member 4391. When the fifteenth gear 437 and the seventeenth gear 439 are rotating, the eccentric gear 4371 and the switching member 4391 drive the connecting-rod mechanism 44.

The connecting-rod mechanism 44 comprises a slide block 441, a first connecting rod 442, a second connecting rod 443, a third connecting rod 444, a fourth connecting rod 445, and a swing rod 449. The slide block 441 slides corresponding to a rear side of the moving picture 5 inside the cover unit 2. On the slide block 441 has a pushing groove 4411. The pushing groove 4411 is worked with the eccentric gear 4371, in a way that the gear sets 41, 42 and 43 are connected between the sound-emitting device 3 and the connecting-rod mechanism 44. So, when the fifteenth gear 437 rotates, the eccentric gear 4371 pushes the pushing groove 4411 of the slide block 441, making the slide block to move reciprocally left and right.

The middle parts of the first connecting rod 442 and the second connecting rod 443 are respectively pivoted by screws 446 and 447 to the rear side of the moving picture 5 inside the cover unit 2. One ends of the first connecting rod 442 and the second connecting rod 443 are joined to the slide block 441, in a way that the slide block 441, in its left and right movement, drives the first connecting rod 442 and the second connecting rod 443 to swing left and right.

One end of the third connecting rod 444 is pivoted to the rear side of the moving picture 5 inside the cover unit 2, while the other end of the connecting rod 444 is joined to one end of the first connecting rod 442, so designed that the first connecting rod 442, in its left and right swinging movement, drives the third connecting rod 444 to swing left and right.

One end of the fourth connecting rod 445 is pivoted by a screw 448 to the rear side of the moving picture 5 inside the cover unit 2. Another end of the fourth connecting rod 445 is joined to one end of the second connecting rod 443, so designed that the second connecting rod 443, in its left and right swing movement, drives the fourth connecting rod 445 to swing left and right.

The swinging rod 449 is pivoted to the rear side of the moving picture 5 inside the cover unit 2, one end of the swinging rod 449 pressing against the switching member 4391; so designed that when the seventeenth gear 439 rotates, the switching member 4391 moves one end of the swinging rod 449, making another end of the swinging rod 449 to swing up and down.

The moving picture 5 comprises a frame unit 51, a first moving object 52, a second moving object 53, a third moving object 54, a fourth moving object 55 and a fifth moving object 56. The frame unit 51 is accommodated inside the second accommodating space 21 of the cover unit 2. The frame unit 51 is a hollow casing with an open front. The first moving object 52, the second moving object 53, the third moving object 54, the fourth moving object 55 and the fifth moving object 56 are installed inside the frame unit 51. A transparent plate 57 and a frame-shaped decorative panel 58 are disposed at a front side of the frame unit 51.

The first moving object 52 and the second moving object 53 are respectively fastened to front ends of the screws 446 and 447 of the first connecting rod 442 and the second connecting rod 443, in a way that the first moving object 52 and the second moving object 53 are respectively joined to the first connecting rod 442 and the second connecting rod 443. So that, the first connecting rod 442 and the second connecting rod 443, in their left and right swinging movement, drive the first moving object 52 and the second moving object 53 to swing left and right.

The third moving object 54 is fixedly joined to the third connecting rod 444 in a way that the third connecting rod 444, in its left and right swinging movement, drives the third moving object 54 to swing left and right.

The fourth moving object 55 is fastened to a front end of the screw 448 of the fourth connecting rod 445. The fourth moving object 55 is joined to the fourth connecting rod 445, in a way that the fourth connecting rod 445, in its left and right swinging movement, drives the fourth moving object 55 to swing left and right.

The fifth moving object 56 is joined to a rod unit 561. On the rod unit 561 has a protruding plate 562. Another end of the swinging rod 449 is pressing against the protruding plate 562. So designed that the other end of the swinging rod 449, in its up and down swinging movement, drives the fifth moving object 56 to rise and fall. The above components combine to form the present invention of music box container.

Figure 5:
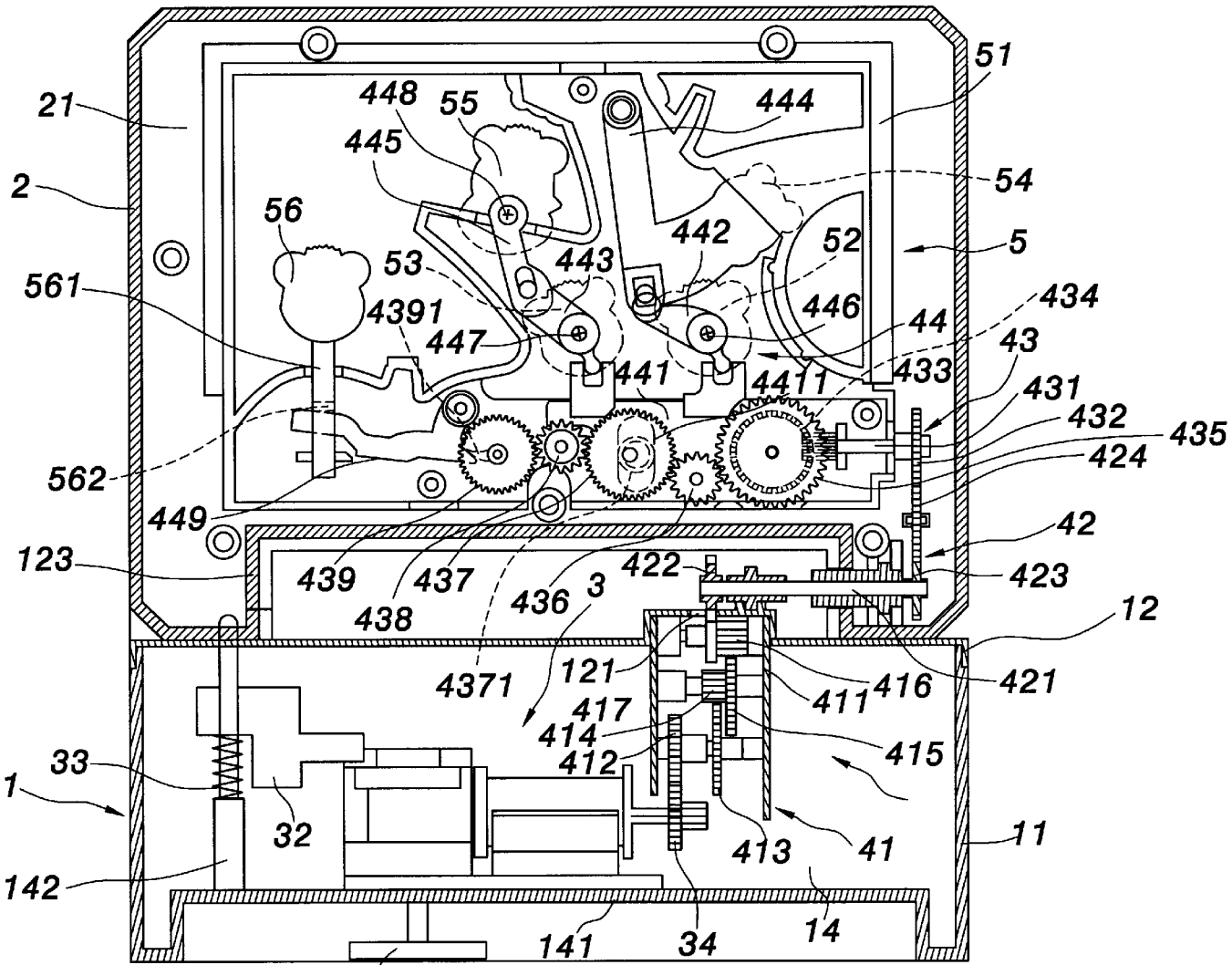
FIG. 5 is a schematic view of the invention in action.

Please refer to FIG. 5, when the sound-emitting device 3 is activated, the first moving object 52, the second moving object 53, the third moving object 54, the fourth moving object 55 and the fifth moving object 56 of the moving picture 5 are driven to swing left and right, and up and down, sequentially by the first gear set 41, the second gear set 42, the third gear set 43 and the connecting-rod mechanism 44 of the transmission mechanism 4. The moving objects are made in the shape of an animal or human. The moving objects of the present invention are capable of swinging left and right and up and down. The present invention is capable of activating a specified number of moving objects to move at the same time, contributing an additional touch of fun and amusement.

To conclude, the present invention is an unprecedented creation with high industrial applicability, novelty and inventive step to satisfy the requirements for a patent right. Your favorable consideration of this application will be appreciated.

Although the present invention has been illustrated and described with reference to the preferred embodiment thereof, it should be understood that it is in no way limited to the details of such embodiment but is capable of numerous modifications within the scope of the appended claims.

BRIEF DESCRIPTION OF NUMERALS

1 box unit
- 11 lower unit
- 12 upper unit
  - 121 first through hole
  - 122 depressed groove
  - 123 joining unit
  - 124 second through hole
- 13 inner box
- 14 first accommodating space
  - 141 protruding unit
  - 142 hole unit
  - 143 guide unit
  - 144 guide groove

2 cover unit
- 21 second accommodating space

3 sound-emitting device
- 31 turning knob
- 32 music cut-off member
- 33 elastic member
- 34 drive output gear

4 transmission mechanism
- 41 first gear set
  - 411 gearbox
  - 412 first gear
  - 413 second gear
  - 414 third gear
  - 415 fourth gear
  - 416 fifth gear
  - 417 sixth gear
- 42 second gear set
  - 421 transmission shaft
  - 422 seventh gear
  - 423 eighth gear
  - 424 ninth gear
- 43 third gear set
  - 431 transmission shaft
  - 432 tenth gear
  - 433 eleventh gear
  - 434 twelfth gear
  - 435 thirteenth gear
  - 436 fourteenth gear
  - 437 fifteenth gear
  - 4371 eccentric gear
  - 438 sixteenth gear
  - 439 seventeenth gear
  - 4391 switching member
- 44 connecting-rod mechanism
  - 441 slide block
  - 4411 pushing groove
  - 442 first connecting rod
  - 443 second connecting rod
  - 444 third connecting rod
  - 445 fourth connecting rod
  - 446 screw
  - 447 screw
  - 448 screw
  - 449 swinging rod

5 moving picture
- 51 frame unit
- 52 first moving object
- 53 second moving object
- 54 third moving object
- 55 fourth moving object
- 56 fifth moving object
  - 561 rod unit
  - 562 protruding plate
- 57 transparent plate
- 58 decorative panel

What is claimed is:

1. A music box container, comprising:

a box unit;

a cover unit, pivoted to said box unit, having an accommodating space therein;

a sound-emitting device, installed inside said box unit;

a transmission mechanism, comprising a gear set and a connecting-rod mechanism, said gear set being connected between the sound-emitting device and the connecting-rod mechanism; and a moving picture, comprising a frame unit and a plurality of moving objects, said frame unit being accommodated inside the accommodating space of the cover unit, said moving objects being installed inside the frame unit, said moving objects being connected with the connecting-rod mechanism, thereby driving said moving objects to swing leftward, rightward, upward, and downward.

2. The box container as claimed in claim 1, wherein said box unit comprises a lower unit, an upper unit, a joining unit and an inner box, said lower unit having an accommodating space formed therein, said upper unit being fixedly accommodated in the accommodating space of the lower unit, said upper unit having a depressed groove formed in a top side thereof, said inner box being fitted inside the depressed groove, said joining unit being fixed at the top side of the upper unit adjacent a rear portion thereof, said cover unit being joined to said joining unit.

3. The music box container as claimed in claim 1, wherein said sound-emitting device has a music cut-off member on one side thereof, on said music cut-off member being fitted an elastic member pressing and moving it upward, an upper end of said music cut-off member extending from a top of the box unit, said cover unit, when in a covered status, pressing against the music cut-off member to move downward, to the effect that the music cut-off member reaches into the sound-emitting device to obstruct the sound-emitting device.

4. The music box container as claimed in claim 1, wherein said sound-emitting device is joined to a drive output gear, the gear set of said transmission mechanism comprising a first gear set, a second gear set and a third gear set, said drive output gear being engaged with the first gear set, said third gear set being joined to the connecting-rod mechanism.

5. The music box container as claimed in claim 1, wherein said connecting-rod mechanism comprises a slide block, a plurality of connecting rods and a swinging rod, said slide block sliding inside the cover unit, on said slide block being a pushing groove, one gear of said gear set having an eccentric gear, said pushing groove working with the eccentric gear, said connecting rod and swinging rod being joined to a rear side of a moving picture, said connecting rod being joined with the slide block, one gear of the gear set having a switching member, one end of said swinging rod pressing against the switching member.

6. The music box container as claimed in claim 1, wherein a transparent plate and a decorative panel are installed at a front side of the frame unit of the moving picture.

* * * * *